US005973616A

United States Patent [19]

Grebe et al.

[11] Patent Number: 5,973,616

[45] **Date of Patent: *Oct. 26, 1999**

[54] PAGER SUPPORTED TRAFFIC SIGNAL CONTROLLER

[75] Inventors: Mark Douglas Grebe, Chandler; Thomas Michael Fox, Gilbert, both of Ariz.

[73] Assignee: Motorola, Inc., Schaumburg, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/917,124

[22] Filed: Aug. 25, 1997

[51] Int. Cl.[6] ..... G08B 5/22

[52] U.S. Cl. ..... 340/825.69; 340/825.44; 340/906; 340/907

[58] Field of Search ..... 340/906, 907, 340/913, 912, 916, 642, 914, 915, 931, 924, 825.69, 825.44, 870.02, 825.49, 825.47, 825.51, 825.22; 455/57.1, 67.7

[56] References Cited

U.S. PATENT DOCUMENTS

| | | | |
|---|---|---|---|
| 2,355,607 | 8/1944 | Shepherd | 340/906 |
| 5,014,052 | 5/1991 | Obeck | 340/906 |
| 5,600,312 | 2/1997 | Willard et al. | 340/825.47 |

*Primary Examiner*—Michael Horabik
*Assistant Examiner*—Jean B. Jeanglaude
*Attorney, Agent, or Firm*—Bradley J. Botsch; John C. Scott; Frank J. Bogacz

[57] ABSTRACT

A local traffic signal controller (3) is interfaced to a conventional pager (16) to provide for centralized control of the traffic signals controlled by the local controller. The central controller (7) may use the existing pager infrastructure (12) to provide for the transfer of program control information to local controllers. A two-way pager may be utilized to provide for the return of information from the local traffic signal controller. Such return information may include indications of lamp failures, traffic pattern information and other status or traffic related information.

12 Claims, 1 Drawing Sheet

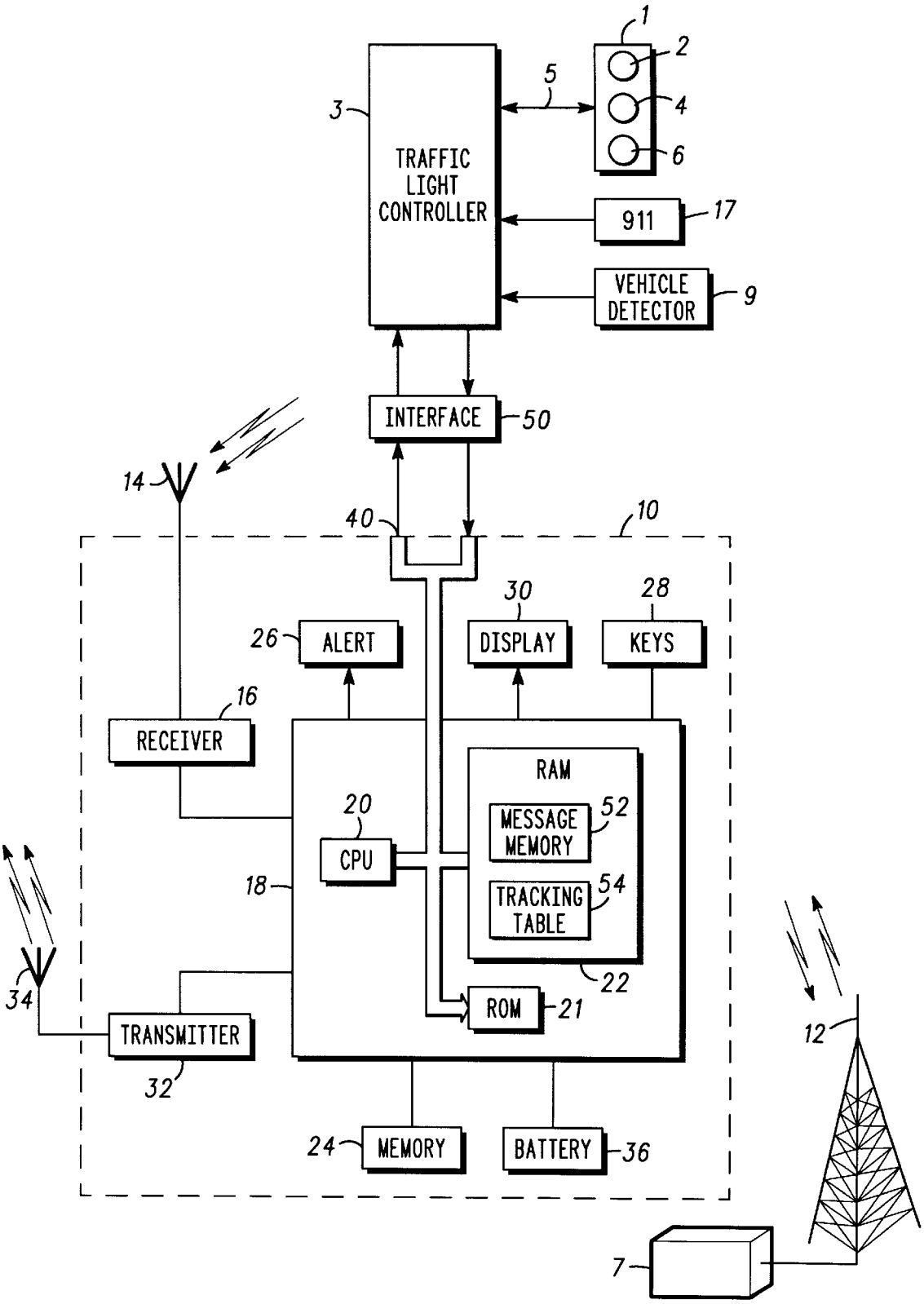
1
2
4
6
5
3
TRAFFIC LIGHT CONTROLLER
911
17
VEHICLE DETECTOR
9
INTERFACE
50
14
40
10
30
28
26
ALERT
DISPLAY
KEYS
16
RECEIVER
RAM
20
MESSAGE MEMORY
52
CPU
18
TRACKING TABLE
54
22
34
ROM
21
TRANSMITTER
12
32
24
MEMORY
BATTERY
36
7

PAGER SUPPORTED TRAFFIC SIGNAL CONTROLLER

BACKGROUND OF THE INVENTION

This invention pertains to a system for controlling vehicular traffic control signals.

Vehicular traffic at intersecting streets is typically controlled by traffic control lights. These lights include the well known red, yellow and green lights as well as lights to indicate protected turns. Typically the lights are operated in accordance with predetermined timing sequences by a controller. Various controllers have been developed and used to control traffic lights. The controllers in use include electromechanical controllers of various types, electronic controllers, and controllers which include microprocessors to generate various timing and control signals. One disadvantage with such traffic signal controllers is that to change the operation of the traffic lights at an intersection, an individual would either be required to travel to the intersection and enter permanent or temporary changes into the controller or use a dedicated telephone line contact and cause the changes. Changes in the operation of the controller may be desirable to modify the timing of the lights or the sequence of operation. Such changes may be necessary as a result of changed traffic patterns, special events, construction or for numerous other reasons.

There are traffic control systems in which centralized computers control local controllers. A significant disadvantage to centralized control systems is that each local traffic signal controller is physically located near the traffic signals to be controlled and the centralized control arrangement must communicate with the traffic signal controllers either over a hard wired network, phone line or by means of specialized radio equipment. The expense of providing centralized control of traffic control signals over a large number of intersections is often prohibitive.

The problem of traffic management under varying conditions is a significant problem and one for which an inexpensive solution is desired.

BRIEF DESCRIPTION OF THE DRAWING

The invention will be better understood from a reading of the following detailed description taken in conjunction with the drawing in which:

The sole FIGURE illustrates in block diagram form a traffic controller in accordance with the principles of the invention.

DETAILED DESCRIPTION

A traffic control system in accordance with the invention is shown in the Figure. In that arrangement, a traffic signal 1 is oriented above an intersection. Although only one traffic signal device 1 is shown, as is commonly known, there may be one or more such devices at an intersection for each direction of traffic. In addition, the traffic signal 1 as shown has only three signal lights, i.e., a red light 2, a yellow light 4 and a green light 6, but as is well known, the traffic signal 1 may include other lights for protected turns. The traffic signal 1 may therefore be of any known construction and arrangement.

The traffic signal 1 is connected to a traffic light controller 3 via a bus 5. The traffic light controller 3 may be of any conventional design and may, for example, utilize a micro controller to control the timing sequence of operation of the signal lights 2, 4 and 6. The controller 3 may for example, be a controller such as the local controller shown and described in U. S. Pat. No. 3,816,796. The teachings of that patent are incorporated herein by reference.

In the system shown in the '796 patent, a central computer is used to provide centralized monitoring and control of a number of local traffic controllers. One disadvantage of this system as well as other systems in which a central control arrangement is provided is that expensive hard wired connections such as voice grade telephone lines must be run to each local controller. Alternatively expensive radio transceivers must be provided at each local controller and a specialized radio communication system must be established. This has the additional inconvenience of requiring Federal Communications Commission licensing for the transmitters. Still further, these prior systems typically require that the entirety of existing traffic signal controllers be replaced in order to be compatible with the control arrangement.

In accordance with the principles of the invention, the specific details of the traffic light local controller 3 are of little significance. The controller 3 may be an older electromechanical controller, or it may be a microprocessor controlled controller or it may be a local controller designed to operate with a central controller 7. The central controller 7 has the functionality of the master controller described in the referenced patent. However, controller 7 is not connected to a plurality of local controllers via telephone or hard wired connections. The central controller 7 may access any local controller in the system of the invention by accessing the local controller via the telephone number of its associated pager 10 and send information to the local controller 3 via conventional paging facilities which are shown schematically as a radio tower 12. It will be understood by those skilled in the art that there is known infrastructure in a paging system and it is not intended by the schematic illustration of a paging system by means of the tower 12 that the invention is to be in any way limited. The controller 3 may have all known functionality of prior system controllers, whether designed as local controllers in a centralized system such as described in U. S. Pat. No. 3,816,796 or whether designed as a stand alone controller which includes microprocessor control or electronic control or electromechanical control. For example, the controller 3 may operate with vehicle detector 9. Vehicle detectors are well known in the art. Such detectors may include induction loop devices or magnetic stripes used to sense the presence of vehicles. When one or more vehicles are detected, the operation of the traffic lights may be changed by the controller operating in a different predefined mode of operation. For example, with a vehicle detector positioned in a left turn lane, the controller 3 may cause a protected turn light to operate as part of the timed sequence of operation of the traffic signal, or it may provide for an extended green light in the direction of traffic in which the turning vehicle is headed before the turn.

The controller 3 may also respond to other traffic control devices, such as a "push to walk" button or buttons 17. The controller may also provide timing control of "Walk/ Don't Walk" lights. Controller 3 may also respond to conventional emergency vehicle priority control arrangements such as the use of strobe lights on emergency vehicles to control the traffic light 1. In addition, the controller may include circuitry to detect failure of a signal light 2, 4 and 6, the "Walk/Don't Walk" indicators and the vehicle detector 9.

Prior art traffic management systems typically rely heavily on a local human presence to modify traffic light behavior, detect traffic related problems, detect problems with the traffic lights and provide information for statistical analysis such as the number of vehicles per unit of time. In accordance with the invention, a conventional pager 10 is interfaced to the traffic signal controller 3 by means of interface circuit 50. The pager may be a conventional, commercially available pager such as a pager available from manufactured by Motorola Inc. The pager 10 is described in detail in U.S. Pat. No. 5,631,635 the disclosure of which is specifically incorporated herein by reference. Although not described in the '635 patent, the pager 10 includes a digital signal port 40 which is used in the pager manufacturing facility to program and test the pager 10. This port 40 is readily visible on many pagers. In accordance with the invention, this digital port 40 is used to provide signal information to the controller 3 which is received by the pager 10. In addition, with two-way pagers, the digital port 40 is also adapted to receive digital signals which may be used as a message to be transmitted back through the paging facility 12. The pager shown in the embodiment of the Figure is a two way pager and includes a digital output from port 40 which is coupled to the interface 50. Interface 50 converts the signal outputs from the pager 10 to signals appropriate to the particular controller 3. For example, if the controller 3 is a microprocessor based controller, the interface 50 may merely provide signal conversion and isolation. If the controller is implemented with electromechanical devices, the interface 50 may provide more extensive signal conversion and isolation. In addition, the interface 50 provides for signal conversion and isolation for signals received from the controller which are to be provided to the pager 10. As will be appreciated by those skilled in the art, the design of interface units between a pager such as pager 10 and a traffic signal controller 3 is straight forward. This is an advantage to the present invention in that any traffic light controller may be coupled into a central controlled traffic system by merely selecting an appropriate interface 50 and placing a pager 10 at the local controller. Each pager has a unique telephone number associated with it and the central controller 7 can selectively address a traffic controller by its pager telephone number. Thus, the central controller 7 can selectively address a local controller and transmit a new program or a program update to the controller via conventional telephone based pager systems and achieve many of the advantages of prior centralized traffic control systems without the costs associated of having a hard wired system or having a telephone line and modem connected to the controller.

With a two-way pager, such as the one shown in the Figure the traffic light controller 3 can provide response information back to the central controller 7. The response information may be as simple as an acknowledgment that information sent by the central controller 7 has been received or it may include additional response information. In addition, the response back from the pager may also include information initiates at the traffic controller 3 such as a 911 call initiated by having a 911 call button 17 disposed in the vicinity of the traffic controller 3 and having it coupled to the controller 3.

In addition, the use of a vehicle detector 9 with the traffic controller 3 permits the controller to also be used to collect information regarding traffic volume at the intersection where the controller is located. This traffic information may, if a two-way pager 10 is employed, be transmitted via the pager system back to the central controller 7. The central controller 7 may then be use to change the operation of the local controller 3 to reflect a necessary change in operation of the traffic light 3. Also, the local controller may include circuitry which detects failure of one of the traffic lights 2, 4 or 6, the "Walk/Don't Walk" indicator or detector 9 and sends a message via the two-way page 10 to central controller 7 to request service.

Still further in accordance with the principles of the invention, by providing a pager at the traffic signal controller, an emergency vehicle may direct control of the traffic signal by using a cellular phone to dial the pager numbers of traffic controllers along it expected route to control operation thereof.

In operation, the traffic light controller 3 controls the timing and sequence of the traffic light based on a program contained in the controller 3. With the connection to pager 10, the central controller 7 can reprogram the controller 3 by transmitting programming information via the pager system 12. Although the pager 10 may be one of the currently available one way pagers, it is advantageous to utilize a two-way pager such as described in the '635 patent. With two-way page capability, the new programming information transmitted to the central controller would be authenticated to prevent tampering with the traffic light controls. The two-way pager can also return information to the paging infrastructure to indicate traffic signal light bulb health, traffic statistics, 911 button status and acknowledgment of new programming information.

As will be appreciated by those skilled in the art, the invention has been shown and described in terms of one illustrative embodiment and that various changes and modifications may be made without departing from the spirit or scope of the invention. It is intended that the invention not be limited to the embodiment shown but that it be limited in scope only by the claims as appended hereto.

What is claimed is:

1. A traffic control system, comprising:

at least one traffic signal;

a traffic signal controller coupled to said traffic signal for controlling operation thereof based upon a predetermined program a pager coupled to said traffic signal controller to provide first information to said traffic signal controller, said pager receiving said first information from a paging system via a first wireless communications link, said paging system including a receiver for receiving page initiation messages from a plurality of sources outside said paging system, each of said page initiation messages comprising a request to establish a wireless communications link between said paging system and at least one specified pager;

an interface circuit disposed between said pager and said traffic signal controller to convert said first information between a first signal format supported by said pager and a second signal format supported by said traffic signal controller;

a central traffic controller, remote from said paging system, including means for determining said first information and means for delivering a page initiation message to said paging system requesting that a first wireless communications link be established between said paging system and said pager for use in delivering said first information to said pager;

said pager is a two-way pager;

said traffic signal controller provides second information to said pager for transmission to said central traffic controller;

a vehicle detector coupled to said traffic signal controller, wherein said second information comprises traffic volume information; and means for transmitting said traffic volume information to said plurality of pagers for re-transmission to said central traffic controller.

2. A traffic control system in accordance with claim 1 wherein:

said first information comprises software for use in reprogramming said traffic control system.

3. A traffic control system in accordance with claim 1, wherein:

said traffic signal controller comprises a program controlled microprocessor to control operation of said at least one traffic signal.

4. A traffic control system in accordance with claim 1, wherein:

said traffic signal controller comprises electro-mechanical controls.

5. A traffic control system in accordance with claim 1, wherein:

said pager includes a signal port, said signal port being coupled to said traffic signal controller.

6. A traffic control system in accordance with claim 5, wherein:

said signal port is coupled to said traffic signal controller to provide first information signals to said traffic signal controller and to receive second information signals from said traffic signal controller.

7. A traffic control system in accordance with claim 5, comprising: an interface circuit disposed between said pager signal port and said controller to interface said first information signals to said traffic signal controller and to interface said second information signals from said traffic signal controller to said signal port.

8. A traffic control system in accordance with claim 1, wherein:

said means for delivering a paging request includes means for dialing a telephone number associated with said pager.

9. A traffic control system in accordance with claim 8, wherein:

said at least one traffic signal includes a plurality of traffic signals each having a dedicated traffic signal controller and a dedicated pager; and said central traffic controller is a stationary unit that is capable of communicating with each of said dedicated pagers via said paging system from a single location.

10. A traffic control system, comprising:

a plurality of traffic signals;

a plurality of traffic signal controllers, each of said plurality of traffic signal controllers being coupled to and colocated with one of said plurality of traffic signals for controlling operation thereof;

a plurality of pagers, each of said plurality of pagers being coupled to and colocated with one of said plurality of traffic signal controllers for use in transferring information between said traffic signal controller and a paging system;

wherein said paging system includes a multichannel wireless transmitter that is substantially stationary with respect to said plurality of traffic signals, said multichannel wireless transmitter for establishing separate wireless communications links with each of said plurality of pagers;

a central traffic controller, remote from said plurality of traffic signals, for determining first information for use in programming each of said plurality of traffic signal controllers and for delivering said first information to each of said plurality of traffic signal controllers via said paging system;

said central traffic controller is remote from said paging system and includes means for delivering a page initiation message to said paging system for a wireless communications link to be established between said paging system and a selected one of said plurality of pagers;

said paging system is independent of said traffic control system and can process page initiation messages from sources other than said central traffic controller; and said paging system transmitting traffic control volume information to said plurality of pagers for re-transmission to a central traffic controller.

11. A method for controlling traffic in a traffic control system having a traffic signal, a traffic signal controller coupled to the traffic signal for controlling operation of the traffic signal based upon a predetermined control procedure, and a pager coupled to said traffic signal controller, said method comprising the steps of:

determining, at a remote location from said traffic signal, a modification to be made in the predetermined control procedure of the traffic signal controller;

delivering a page initiation message to a paging system by dialing a telephone number associated with the pager;

establishing, in response to said page initiation message, a wireless communications link between said paging system and the pager;

delivering information to said pager from said remote location via a communications path including said wireless communications link;

modifying said predetermined control procedure in said traffic signal controller using said information;

said wireless communications link is a bidirectional link for supporting communications from said paging system to the pager and communications from the pager to said paging system;

transmitting by said bidirectional link traffic control volume information to said pager for re-transmission to a central traffic controller.

12. The method, as claimed in claim 11, wherein:

said step of modifying includes replacing a control program stored in a memory associated with said traffic signal controller.

* * * * *